186-307 SR
12/2/86 XR 4,625,803

United States Patent [19]
Walhaug et al.

[11] Patent Number: 4,625,803
[45] Date of Patent: Dec. 2, 1986

[54] METHOD AND APPARATUS FOR INJECTING WELL TREATING LIQUID INTO THE BOTTOM OF A RESERVOIR INTERVAL

[75] Inventors: Warren W. Walhaug; Boyd B. Moore, both of Houston, Tex.

[73] Assignee: Shell Western E&P Inc., Houston, Tex.

[21] Appl. No.: 736,160

[22] Filed: May 20, 1985

[51] Int. Cl.[4] ..... E21B 37/06; E21B 41/02; E21B 43/27

[52] U.S. Cl. ..... 166/310; 166/97.5; 166/179; 166/279; 166/307; 166/313; 166/371; 166/902

[58] Field of Search ..... 166/902, 97.5, 179, 166/188, 242, 279, 310, 312, 307, 305.1, 313, 384, 371

[56] References Cited

U.S. PATENT DOCUMENTS

| | | | |
|---|---|---|---|
| 3,132,694 | 5/1964 | McGlasson et al. | 166/305.1 X |
| 3,548,946 | 12/1970 | Engle | 166/310 |
| 3,566,970 | 3/1971 | Crow et al. | 166/310 |
| 3,722,594 | 3/1973 | Smith et al. | 166/307 X |
| 3,765,489 | 10/1973 | Maly | 166/310 |
| 3,770,058 | 11/1973 | Smedley | 166/310 |
| 3,853,176 | 12/1974 | Henrich | 166/312 X |
| 3,878,312 | 4/1975 | Bergh et al. | 166/242 X |
| 3,945,436 | 3/1976 | Nebolsine | 166/312 X |
| 4,399,868 | 8/1983 | Richardson et al. | 166/304 X |
| 4,511,001 | 4/1985 | Wu | 166/310 |

FOREIGN PATENT DOCUMENTS

| | | | |
|---|---|---|---|
| 612901 | 1/1961 | Canada | 166/310 |

*Primary Examiner*—George A. Suchfield

[57] ABSTRACT

Chemical treating liquids (e.g. scale inhibitors) are dispersed in the producing interval by (a) extending a slim tube along the production tube into connection with a more rigid tube extending below a dual packer and the production tube, and (b) inflowing a mixture of gas-saturated treating liquid and gas through the slim tube.

10 Claims, 2 Drawing Figures

METHOD AND APPARATUS FOR INJECTING WELL TREATING LIQUID INTO THE BOTTOM OF A RESERVOIR INTERVAL

BACKGROUND OF THE INVENTION

The invention relates to a method and apparatus for flowing a treating liquid into contact with substantially all of the fluid and equipment in or around a selected bottom portion of a well. More particularly, the invention relates to using a combination of a specified well completion apparatus and treating liquid injecting procedure to effect a dispersion of the treating liquid within a selected portion of the well.

Well treating liquids are well known. Such fluids include scale inhibitors, comprising liquids which are commonly squeezed into the production interval of a well and subsequently allowed to precipitate or be absorbed on the rocks so that they are gradually returned to the wellbore by fluids being produced. Scale inhibitors are described in U.S. Pat. Nos. such as 3,943,059; 3,704,750; 3,661,785; 3,633,672; 3,483,925 and 3,467,192. Other treating liquids comprise hydrate inhibitors such as those described in U.S. Pat. Nos. such as 3,676,981 and 4,235,289. Reservoir acidizing fluids are or form treating liquids which are injected into a reservoir interval to dissolve solids from pore spaces in and around the borehole. Hydrocarbon fluids such as solvents or oil-emulsifying surfactant systems, for removing organic solids from fluid passageways in and around the borehole, comprise another type of well treating liquids, etc.

However, as discussed in U.S. Pat. No. 4,399,868 by E. A. Richardson and W. B. Fair, Jr., where a well contains in a relatively dense brine, it is often difficult to cause a relatively light liquid such as an organic solvent to contact perforations or other passageways below the top of a column of the brine. U.S. Pat. No. 4,399,868 describes a process for injecting a nitrogen gas-generating aqueous liquid solution (optionally accompanied by an organic solvent) to sink below the brine and generate heat and gas to disperse hot liquid into contact with the materials near the bottom portion of the reservoir interval.

SUMMARY OF THE INVENTION

The present invention comprises a process for dispersing a well treating liquid in or around a selected depth within a well to be treated. The well is equipped with a dual packer which is (a) connected into a segmented first tubing string, (b) connected into an upper portion of a relatively stiff tubing string that provides a separate second string extending to the selected depth in the well, and (c) connected to the lower portion of a spoolable tubing string which opens into the top of said second tubing string and is strapped along the first tubing string from a surface location to a location at least near the packer. A mixture comprising a well treating liquid and a gas which is significantly soluble in the treating liquid at the mixing temperature and pressure, but is less soluble in that liquid at the reservoir temperature and pressure, is formed and injected through the continuous tubing string. This conveys the mixture into the selected lower portion of the well and discharges it into a relatively hot downhole zone. In that zone the agitation from the releasing of the injected and dissolved gas agitates liquid within the well and disperses the treating liquid throughout the selected portion of the well and adjacent permeable material, such as the first tubing string and/or reservoir formation.

Where desirable, the mixture of well treating liquid and gas can contain, or be injected in conjunction with, additional components which are dissolved in, or homogeneously dispersed within, either or both gas and liquid phases of the mixture. For example, in a well producing a $CO_2$-displaced fluid, the injected mixture can advantageously comprise methanol mixed with a scale inhibitor and gaseous $CO_2$, to prevent potential downhole hydrate-formation within the production tubing.

DESCRIPTION OF A PREFERRED EMBODIMENT

Figure 1:
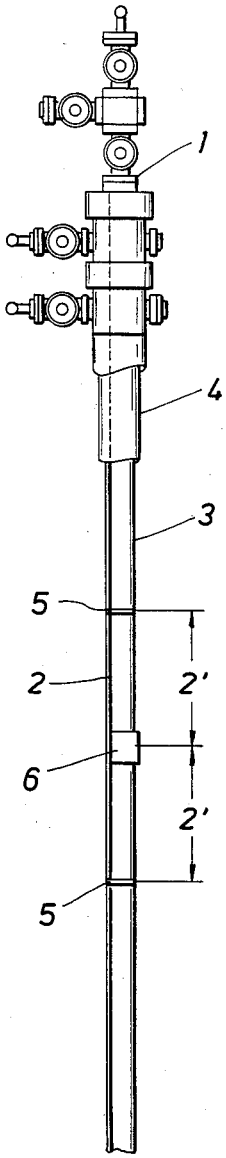
FIGS. 1 and 2 schematic illustrations of upper and lower portions of a well in which the present apparatus is installed.
Figure 2:
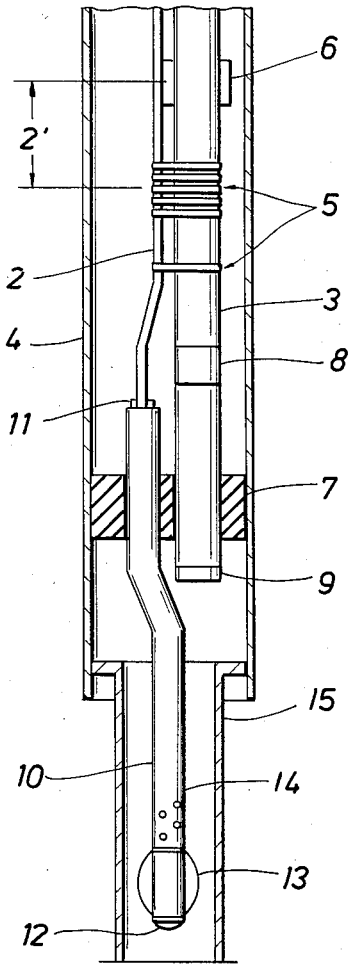

The well shown in FIGS. 1 and 2 comprises an embodiment of the invention which can be installed by means of currently available methods and equipment. The well is equipped with a feed-through means 1 for accommodating an insertion of a spoolable continuous tubing string 2, such as ½" 316 SS tubing, which is extended along the exterior of a segmented tubing string 3, such as 2⅞" Eve 8 RD FG lined tubing, which is hung within a casing string 4, such as a 7-inch casing. The continuous tubing 2 is connected along the production tubing 3 by means of straps 5, such as 3/16th-inch stainless steel straps. In a particularly preferred embodiment, near the tubing coupling joints or collars 6, the straps 5 are spaced away from the collars by about 2 feet, as shown on the drawing, so that the continuous tubing curves smoothly upward along the collar.

The production tubing string 3 is connected into a dual string packer 7, such as a 7" DHP @5190' Baker Model ALP-5 (CR-1 MO), which is mounted a short distance below a crossover 8, such as a X-Over 2⅞" EVE 8 RD(BOX) x A-95 Hydril (Pin). The packer 7 closes the annulus between the tubing and the casing strings at a depth near but above a reservoir into which the well is opened. A short distance below the packer the tubing string 3 is terminated with a landing nipple 9, such as a 2⅞" Landing Nipple A-95 Hydril 1.78" ID Baker Model R (9CR-1 MO), a short distance above the packer the continuous tubing string 2 is open into the upper end of a relatively stiff tubing string 10, such as a 1½" 316 SS tubing, having its near top portion surrounded by the packer 7. The tubing 10 extends through the packer and provides a second tubing string extending below the packer and into the selected depth within the well at which the treating fluid is to be injected. The connection of the tubing 2 into the tubing 10 is effected by a crossover 11, such as a X-Over ½"×1½"10 RD. A bull plug 12 is connected to the bottom of the tubing string 10 below a centralizer 13 above which there are tubing perforations 14, such as a 2-foot section containing about 2 holes (having a diameter of about ½-inch) within each foot. A slotted liner 15 extends below the bottom of casing 4 and provides openings between the borehole of the well and the pores of the reservoir formation.

In conducting the present process, an aqueous or oleic well treating liquid is mixed with a gas which is significantly soluble in that liquid at the temperature of the mixing location and is significantly less soluble in that liquid at the reservoir temperature. The mixing is preferably done at a pressure at least substantially equaling the pressure into which the mixture is to be injected and a temperature significantly lower than that into which the mixture is to be injected. The mixture is injected through the spoolable tubing string 2 and into the well at the selected depth.

The well treating liquid used in the present process can comprise substantially any liquid capable of effecting a desired physical or chemical interaction with materials in and around the bottom of the well and the production tubing string. The gas which is mixed with that liquid can comprise substantially any which is both compatible with the liquid and the desired treating action and significantly soluble in that liquid at a suitable surface mixing temperature while being significantly less soluble in that liquid at the reservoir temperature. Aqueous or oleic liquid solutions of scale inhibitors or corrosion inhibitors are particularly suitable liquids for use in this invention. In general, any gases which are substantially inert to petroleum hydrocarbons and the reactive components of the treating liquid can be used. Examples of such gases include $CO_2$, nitrogen, or natural gas, each of which are particularly suitable gases for such use. The gases used can be used by themselves or as components of a mixture of gases, some of which may be more soluble than others in the liquid being used.

In general, in treating a producing well, the production tubing string and dual string packer connected into the tubing string can suitably be devices which are currently known and available. Hydraulic-set packers such as the Otis Dual Hydraulic-set Packer, type RDH, available from Otis Engineering Company are particularly suitable items for use in the present invention. The spoolable tubing string connected from a surface location to the top of the packer and the second tubing string connected below the packer can also be commercially available items. The use of a ½-inch stainless steel tubing with a 1½-inch segmented pipe string extending below the packer is a particularly suitable combination.

As will be apparent to those skilled in the art, the present completion system can advantageously be used in a production well in which the produced fluid is transported to the surface in response to substantially any means, such as the pressure gradient from a reservoir formation to a surface location, beam or continuous pumping, gas-lifting, etc.

For example, the invention is particularly applicable to a well producing in response to a $CO_2$ drive in which oil is displaced into production wells (e.g. about 5,000 feet deep) by $CO_2$ injected (e.g. at pressures in the order of 2000 psi). Without a scale inhibitor, such production wells are apt to undergo severe calcium carbonate and/or sulfate scaling. In such a situation, although carbonate scale can be removed with scale converters such as Alco D230 and acidization followed by an inhibitor squeeze (for example, using Tretolite SP 181 or 183), the production decline is apt to be in the order of 10 to 70 percent per year. Since carbon dioxide is readily available in such a field, the use of an aqueous solution of a scale inhibitor (such as Tretolite SP-290 or Exxon 7647) mixed with carbon dioxide gas at ambient temperature and bottom hole injection pressure may comprise a particularly attractive embodiment of the present invention. The concentration required for a continuous injection of the inhibitor can be relatively small, i.e. on the order of 20 to 25 ppm of the total produced fluid. The continuous treatment is expected to avoid cleanout and acidizing treatments (which average about $20,000.00 per job) while sustaining the oil production at relatively high levels. In such a continuous treatment, an oleic liquid solution of an oil base scale inhibitor (such as Tretolite SP-181) could also be used. In addition, in wells showing a tendency for hydrate formation and/or corrosion, the components of or materials injected into conjunction with the mixture of liquid treating fluids and gas can include or be injected in conjunction with hydrate inhibitors such as methanol or ethylene glycol, or the like, and/or scale inhibitors.

In a situation in which it may be desirable to treat the interior of a production well and/or the face of a reservoir formation with a treating liquid without injecting a significant amount of liquid into the reservoir, the well can advantageously be equipped with the presently described fluid injecting apparatus. The apparatus can be used to spot a fluid, e.g. an acid, at a selected depth by producing fluid against a backpressure creating a bottomhole pressure near that of the reservoir pressure while injecting the treating liquid through the continuous tubing string, with or without mixing it with gas, at an injection rate near the rate fluid is being produced. Then, with only a minor interruption in production, the so-spotted treating fluid can be injected into the reservoir by closing the continuous string and pressurizing the fluid in the production string long enough to inject the selected portion of treating fluid.

What is claimed is:

1. A process for dispersing a well treating liquid at a selected depth within the borehole of the well, comprising:

equipping the well with a dual string packer which (a) is connected into a segmented first tubing string, (b) is connected into an upper portion of a relatively stiff tubing string providing a separate second string which extends to the selected depth, and (c) is connected to a lower portion of a spoolable tubing string that opens into the second tubing string, is strapped along the first tubing string and extends from a surface location to at least near to the packer; and injecting through the spoolable tubing string and into the selected depth within the well a mixture of a well treating liquid and a gas, with said mixture being formed at substantially ambient surface temperature and down hole injection pressure and said gas being significantly soluble in the well treating liquid at the mixing temperature but being significantly less soluble in that liquid at the reservoir temperature, so that agitation of liquid within the borehole due to gas being inject along with and released from the solution disperses the treating liquid throughout the selected depth within the well.

2. the process of claim 1 in which the well treating liquid is an aqueous solution of at least one preferentially water-soluble composition of the group consisting of scale, corrosion and hydrate inhibiting composition.

3. The process of claim 2 in which the gas mixed with the well treating liquid is $CO_2$.

4. The process of claim 1 in which the treating liquid mixed with the gas is an oil-base solution of at least one preferentially oil-soluble inhibitor of the group consisting of scale corrosion and hydrate inhibitors.

5. The process of claim 4 in which the gas with which a treating liquid is mixed, consists essentially of $CO_2$.

6. An apparatus for dispersing a treating liquid at a selected depth within a well, comprising:

a cased well containing a dual string packer which (a) is connected into a segmented first tubing string, (b) is connected into an upper portion of a relatively stiff tubing string providing a separate second string that extends into the selected depth within the well, and (c) is connected to a lower portion of a spoolable tubing string which opens into the second tubing string, is connected along the exterior of the first tubing string and extends from a surface location to a location at least near the packer; and means for injecting fluid into the spoolable tubing string.

7. The apparatus of claim 6 in which the spoolable tubing string is connected along the exterior of the first tubing string with steel straps which spaced away from the collars on the first tubing string by distances sufficient to cause a smooth bending of a spoolable tubing as it extends over the collars.

8. The apparatus of claim 6 in which the segmented first tubing string is a production tubing string.

9. The apparatus of claim 8 in which the second string is centralized within the lower portion of the well.

10. The apparatus of claim 9 in which the bottom of the second tubing string is closed below a series of perforations.

* * * * *